US005685760A

United States Patent [19]

Han

[11] Patent Number: 5,685,760

[45] Date of Patent: Nov. 11, 1997

[54] LIGHT EXPOSING DEVICE FOR FORMING BLACK MATRIXES IN CATHODE RAY TUBES

[75] Inventor: Dong-Hee Han, Kyungki-do, Rep. of Korea

[73] Assignee: Samsung Display Devices Co., Ltd., Kyungki-do, Rep. of Korea

[21] Appl. No.: 578,125

[22] Filed: Dec. 26, 1995

[30] Foreign Application Priority Data

Dec. 26, 1994 [KR] Rep. of Korea ..... 94-36914

[51] Int. Cl.[6] ..... H01J 9/20

[52] U.S. Cl. ..... 445/60; 445/63

[58] Field of Search ..... 445/60, 63

[56] References Cited

FOREIGN PATENT DOCUMENTS 63-58730 3/1988 Japan ..... 445/63

63-279537 11/1988 Japan ..... 445/60

4-22043 1/1992 Japan .

2005320 12/1993 Russian Federation ..... 445/60

*Primary Examiner*—P. Austin Bradley

*Assistant Examiner*—Jeffrey T. Knapp

*Attorney, Agent, or Firm*—Lowe, Price, LeBlanc & Becker

[57] ABSTRACT

A light exposing device for fixing a black matrix on the internal surface of a CRT's panel is disclosed. The device includes green, blue and red light exposing units arranged in a casing one after another. Each exposing unit has a light source, a shutter, a compensating lens and a filter. A chucking unit is placed at each side of the device for selectively chucking a plurality of panels seated on the exposing units. The chucking unit is operated by a driving unit so as to move the panels on the device by one pitch. Initial and final waiting sections are provided before the green light exposing unit and after the red light exposing unit, respectively. On the waiting sections, the panels before exposing and after exposing stand by ready to be fed to the green light exposing unit and to be fed to a following process, respectively.

3 Claims, 4 Drawing Sheets

LIGHT EXPOSING DEVICE FOR FORMING BLACK MATRIXES IN CATHODE RAY TUBES

BACKGROUND OF THE INVENTION

1. Field of the Invention

The present invention relates in general to a light exposing device for fixing a black matrix around the fluorescent material coated on the internal surface of a CRT's panel and, more particularly, to a structural improvement in such an exposing device for remarkably reducing the processing time and improving productivity of the CRTs.

2. Description of the Prior Art

The typical process for producing cathode ray tubes (CRT) comprises a step of forming and mounting a shadow mask. The shadow mask, having a thickness of 1–1.5 mm and including hundreds of thousands of slots, is formed through pressing prior to mounting the shadow mask onto a glass panel. After mounting the shadow mask on the glass panel, a cleaning step of removing impurities, such as dust which has settled on both the panel and the shadow mask, is performed. The above cleaning step is followed by a black matrix forming step. In the black matrix forming step, polyvinyl alcohol (PVA) is applied on the internal surface of the panel. The panel with both the shadow mask and the PVA is in turn exposed to light thereby fixing a black matrix on the panel. Thereafter, a fluorescent layer forming step is performed. In this step, red, green and blue fluorescent materials are applied on, and fixed to the panel's internal surface, thus forming a fluorescent layer on the panel's internal surface. The above fluorescent layer forming step is followed by a vacuum deposition step of depositing a reflection layer on the fluorescent layer. Thereafter, a tube forming step is performed. In this step, a glass funnel is airtightly fixed to the above panel. The above tube forming step is followed by a step of placing an electron gun, which has a plurality of grids and cathodes, in the neck of the funnel. The tube in turn is vacuumed prior to sealing the tube. The CRT producing process is ended at an inspection step of checking various performances of the resulting CRT after banding the fixed portion between the panel and the funnel for preventing internal explosion.

In the above CRT producing process, a light exposing device is used for forming the black matrix on the panel's internal surface. An example of the typical exposing device is shown in FIG. 1. As shown in the drawing, the exposing device includes a light source 2 of a mercury arc lamp mounted on the inner wall of a casing 1. Placed above the light source 2 in the casing 1 is a movable shutter 3 for partially intercepting the light emitted from the light source 2. Red, green and blue compensating lenses 4, which compensate for refraction of the light passing through the shutter 3, are fixedly mounted on a turntable driven by a motor 5.

The above exposing device also includes a filter 6. This filter 6 is placed above the compensating lenses 4 and is used for controlling the illumination intensity of the emitted light. The top of the casing 1 has an opening 1*a*. A panel P, which will be exposed to the light emitted from the light source 2, is seated on the opening 1*a*. Mounted to the internal surface of the panel P is a shadow mask M having hundreds of thousands of slots.

When the panel P, which is applied with PVA on its internal surface and provided with the shadow mask M on the PVA, is seated on the opening 1*a* of the casing 1 as shown in FIG. 1, the light emitted from the light source 2 is scanned onto the internal surface of the panel P after passing through the shutter 3, the compensating lenses 4 and the filter 6. The light scanned onto the internal surface of the panel P passes through the slots of the shadow mask M to fix PVA thereby forming the black matrix on the panel's internal surface.

In the above exposing device, the red, green and blue compensating lenses 4 should be appropriately rotated so as to form an optical system prior to exposing. Therefore, the exposing process using the above device wastes much time thereby reducing productivity remarkably. Additionally, as it is impossible to uniform the quality of the resulting black matrixes, the quality difference of products is prominent in the scatter diagram of the products.

In an effort to rectify the above problem, Japanese Laid-open Publication No. Heisei. 4-22043 proposes an exposing device suitable to be commonly used for forming different types of black matrixes of color CRTs.

The above Japanese exposing device is shown in FIG. 2. As shown in this drawing, the device includes a panel locating part 7 onto which a panel P with shadow mask M is seated to be precisely located. The above device also includes two types of lenses, that is, first lens 8*a* and second lenses 8*b*. The first lens 8*a* is formed by composing two exposing optical systems into an optical system and commonly used for the primary colors R, G and B. The second lenses 8*b* are exclusively used for the primary colors, respectively. The second lenses 8*b* are held on an exchangeable lens holder 8 which changes the position of the second lenses 8*b* relative to both the panel P and the light source in accordance with types of the black matrixes. The device further includes a light source driving unit 9 which moves the position of the light source in accordance with types of the black matrixes. With the above construction, the exposing device appropriately exposes the internal surface of the panel P to the light emitted from the light source thereby forming various types of black matrixes.

The above Japanese exposing device somewhat easily changes the lenses 8*b* in accordance with various types of black matrixes having different sizes to be formed. However, the R, G and B exposing processes using the above device should be carried out while moving the lens holder 8 to array the second lenses 8*b* exclusively used for the respective primary colors. The exposing process thus wastes much time and thereby reduces productivity. The above exposing device also fails to uniform the quality of the resulting black matrixes, so that the quality difference of products is prominent in the scatter diagram of the products.

SUMMARY OF THE INVENTION

It is, therefore, an object of the present invention to provide an exposing device for CRTs in which the above problems can be overcome and which carries out the exposing processes in order of R, G and B exposing processes thereby remarkably reducing the exposing time and improving productivity.

It is another object of the present invention to provide an exposing device for CRTs which forms uniform black matrixes and thereby uniforms the quality of products.

In order to accomplish the above object, the present invention provides a light exposing device for fixing black matrixes of a given pattern on panel's internal surfaces, comprising: green, blue and red light exposing units arranged in a casing one after another, each exposing unit having a light source, a shutter for partially intercepting the light emitted from the light source, a compensating lens for compensating for refraction of the light passing through the shutter, and a filter for controlling illumination intensity of the light; means for selectively chucking a plurality of panels seated on the exposing units; and means for moving the panels, chucked by the chucking means, by one pitch.

The above exposing device exposes a plurality of panels with shadow masks to R, G and B light while moving the panels by one pitch, thereby forming black matrixes on the internal surfaces of the panels. As the exposing device exposes the panels to the light while moving the panels by one pitch, the device remarkably saves processing time and reduces cost. In the exposing device, the panels are exposed to the light under the same conditions. Therefore, the device uniforms the quality of black matrixes formed on the internal surfaces of the panels thereby uniforming the quality of the finished products.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
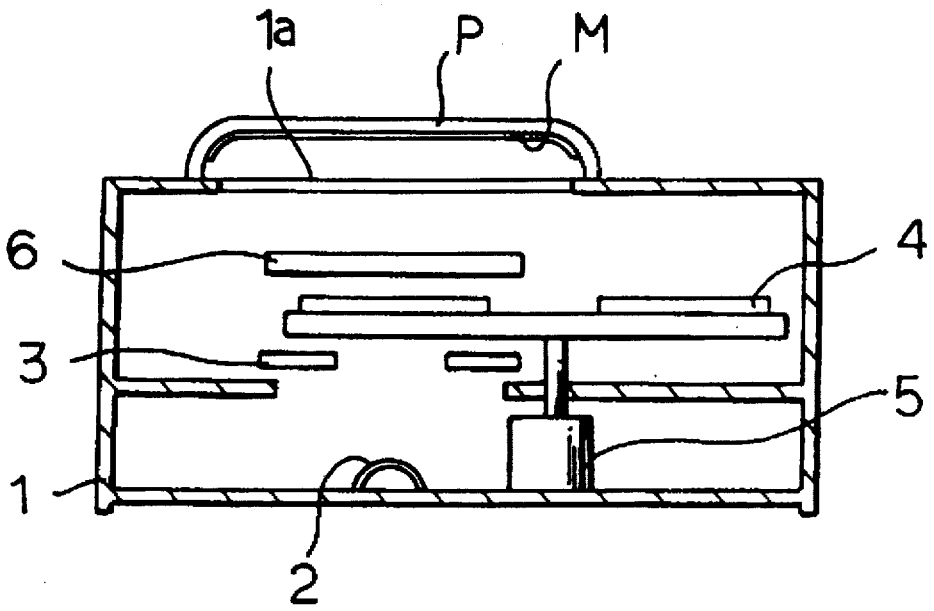
FIG. 1 (PRIOR ART)
FIG. 1 is a sectional view showing the construction of an embodiment of the typical exposing device.
Figure 2:
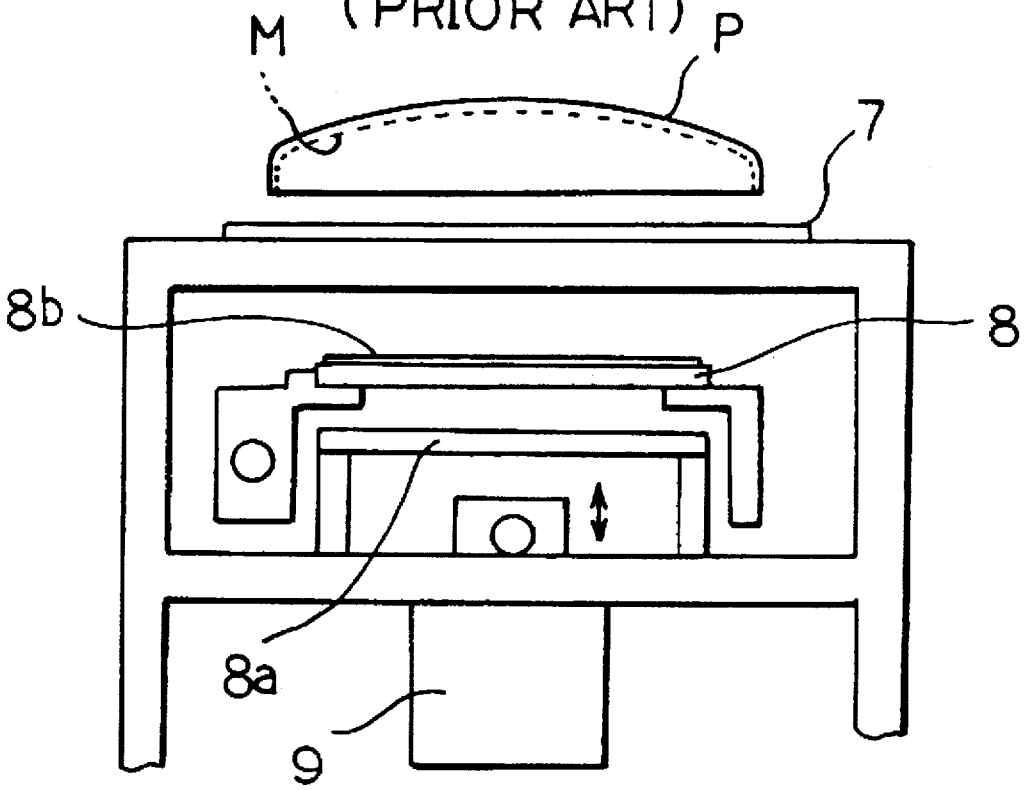
FIG. 2 (PRIOR ART)
FIG. 2 is a sectional view showing the construction of another embodiment of the typical exposing device.
Figure 3:
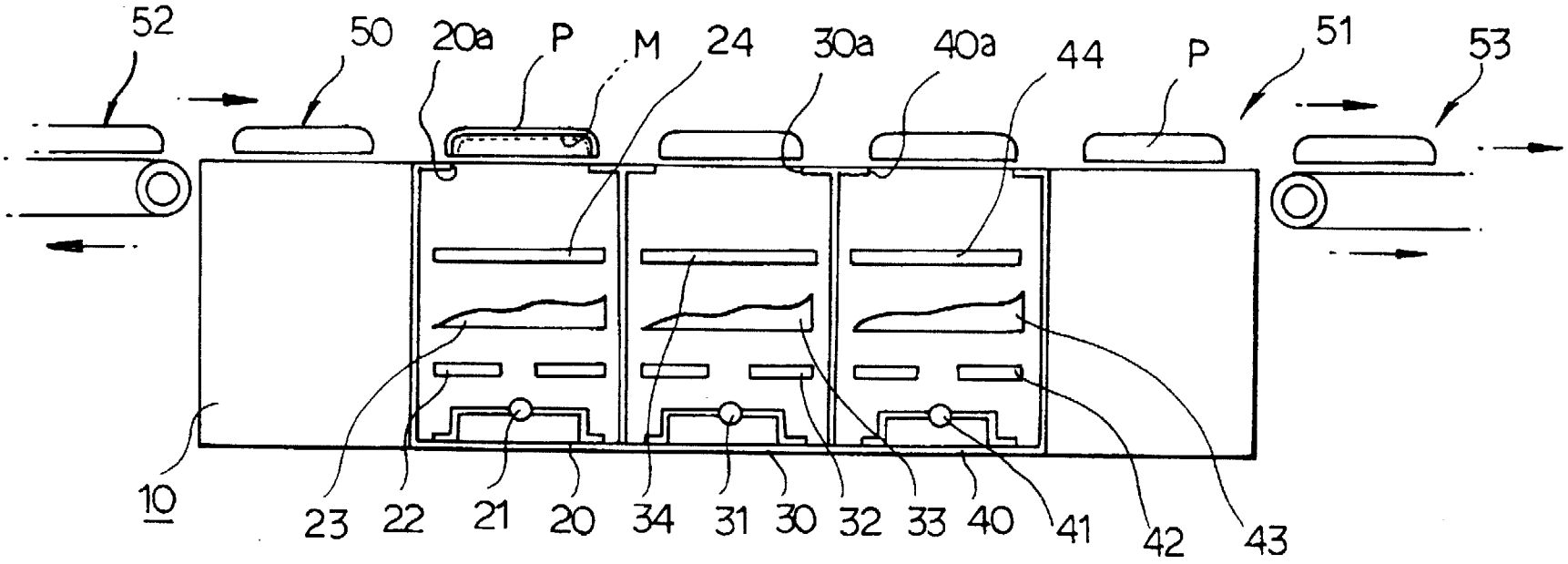
FIG. 3 is a sectional view showing the construction of an exposing device in accordance with a preferred embodiment of the present invention.
Figure 4:
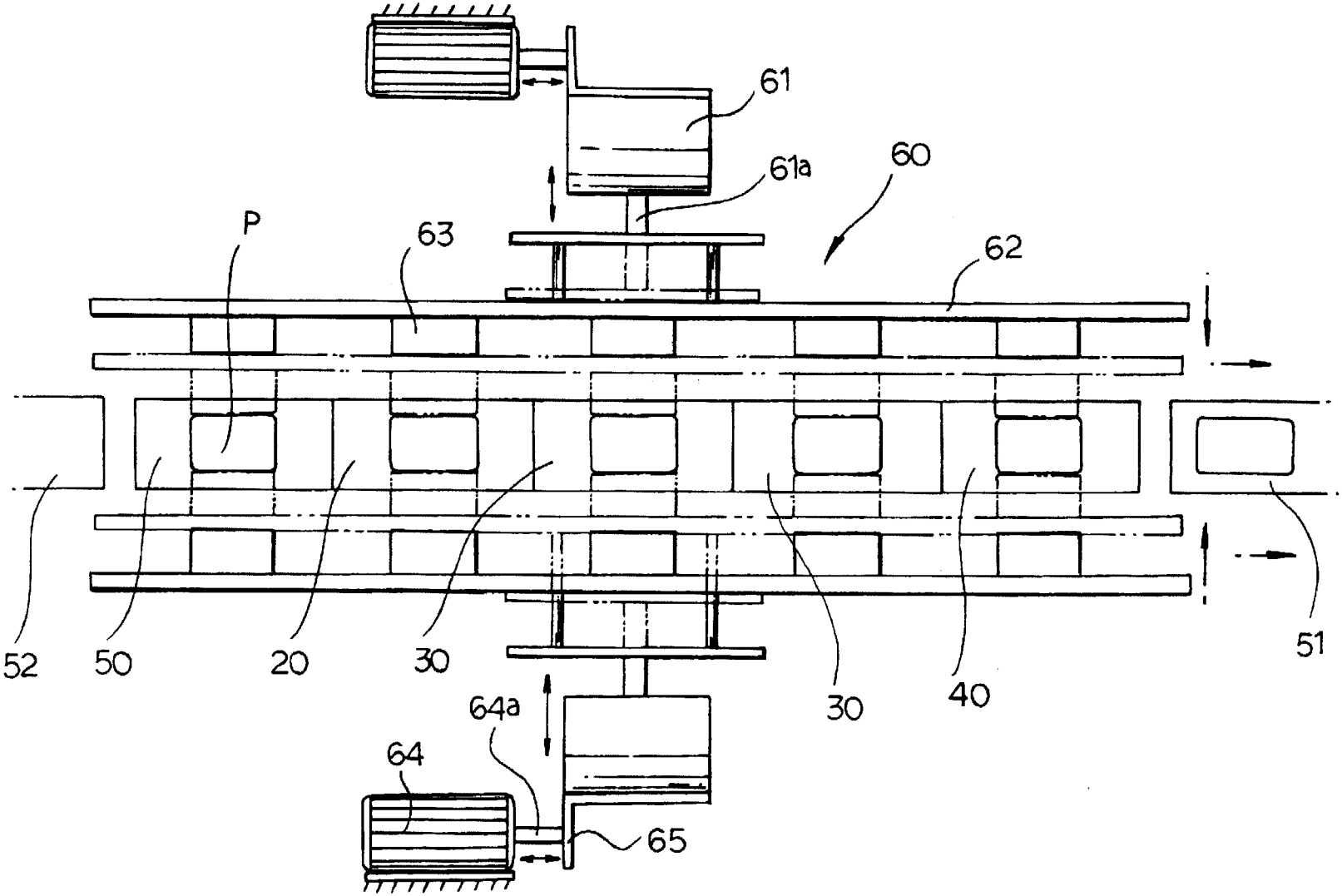
FIG. 4 is a plan view of the exposing device of the present invention.

FIGS. 3 and 4 show an exposing device for CRTs in accordance with a preferred embodiment of the present invention.

In the drawings, the reference numeral 10 denotes a casing of the exposing device. A plurality of exposing units 20, 30 and 40 are arranged in the casing 10 in order of a green exposing unit 20, a blue exposing unit 30 and a red exposing unit 40 from left to right in each drawing.

The green exposing unit 20 includes a light source 21, a shutter 22, a compensating lens 23 and a filter 24 which are orderly arranged in the unit 20. The shutter 22 partially intercepts the light emitted from the light source 21. The compensating lens 23 compensates for refraction of the light passing through the shutter 22. The filter 24 controls the illumination intensity of the emitted light. The light emitted from the light source 21 passes through an opening 20*a* of the unit 20 and in turn is scanned to the internal surface of a panel P with shadow mask M, the panel P being seated on the opening 20*a*. Therefore, the unit 20 exposes the panel P to the green light.

In the same manner as described for the green exposing unit 20, the blue exposing unit 30, which is placed at a side of the green exposing unit 20, includes a light source 31, a shutter 32, a compensating lens 33 and a filter 34 which are orderly arranged in the unit 30. The light emitted from the light source 31 passes through an opening 30*a* of the unit 30 and in turn is scanned to the internal surface of a panel P, the panel P being seated on the opening 30*a*. Therefore, the unit 30 exposes the panel P to the blue light. Similar to the above units 20 and 30, the red exposing unit 40, which is placed at a side of the blue exposing unit 30, includes a light source 41, a shutter 42, a compensating lens 43 and a filter 44 which are orderly arranged in the unit 40. The light emitted from the light source 41 passes through an opening 40*a* of the unit 40 and in turn is scanned to the internal surface of a panel P, the panel P being seated on the opening 40*a*. Therefore, the unit 40 exposes the panel P to the red light.

The above exposing device also includes initial and final panel waiting sections 50 and 51 which are placed at opposite ends of the casing 10, respectively. On the initial waiting section 50 provided in the inlet end of the device, the panel P is standing by ready to be fed to the green exposing unit 20. On the final waiting section 51 provided in the outlet end of the device, the panel P coming out of the red exposing unit 40 is standing by ready to be fed to a following process. Placed at a side of the initial waiting section 50 is a panel supplying conveyor unit 52 which feeds the panel P applied with PVA on its internal surface to the initial waiting section 50. A panel distributing conveyor unit 53, which feeds the panel P coming out of the red exposing unit 40 to the following process, is placed at a side of the final waiting section 51 of the device.

A pair of chucking units 60 are longitudinally placed opposite sides of the above exposing device respectively as shown in FIG. 4. The chucking units 60 not only chuck the plurality of panels P positioned on the units 20, 30 and 40 and on the waiting sections 50 and 51, but also feed the panels P toward the panel distributing conveyor unit 53.

Each chucking unit 60 includes a drive part 61 provided with an actuating rod 61*a*. This rod 61*a* rectilinearly moves in a direction perpendicular to the axis of the exposing device as shown in the arrows of FIG. 4. Fixed to one end of the rod 61*a* is a shuttle frame 62. The shuttle frame 62 is longitudinally positioned at the side of the exposing device and rectilinearly moves within a given range in accordance with a rectilinear motion of the rod 61*a*. Each chucking unit 60 also includes a plurality of regularly spaced chucking members 63 which are mounted on the inside surface of the shuttle frame 62. As the shuttle frame 62 rectilinearly moves relative to the side of the device, the chucking members 63 are either brought into elastic contact with, or separated from the sides of the panels P.

The driving part 61 of each chucking unit 60 also includes panel feeding means 64. This panel feeding means 64 longitudinally moves the chucking unit 60 in a direction parallel to the axis of the device, thereby feeding the panels P chucked by the chucking members 63 by one pitch at one time. The fixed feeding means 64 includes an actuating rod 64*a* which rectilinearly moves in a direction parallel to the axis of the device under the control of the feeding means 64. One end of the actuating rod 64*a* is fixed to a bracket 65 which in turn is fixed to the driving part 61.

The operational effect of the above exposing device will be described hereinbelow.

A plurality of panels P, each of which is applied with PVA to a given thickness on its internal surface and provided with a shadow mask having hundreds of thousands of slots, are fed from the panel supplying conveyor unit 52 to the initial waiting section 50, the green exposing unit 20, the blue exposing unit 30 and the red exposing unit 40 one after another. When a panel P is placed on the opening 20*a* of the green exposing unit 20, the light emitted from the light source 21 passes through the shutter 22, the compensating lens 23 and the filter 24 and in turn is scanned to the internal surface of the panel P. Therefore, the panel P is exposed to the green light. In this case, the light refraction and intensity of illumination are controlled while the light passes through the shutter 22, the compensating lens 23 and the filter 24.

When the panel P is placed on the opening 30*a* of the blue exposing unit 30, the light emitted from the light source 31 passes through the shutter 32, the compensating lens 33 and the filter 34 and in turn is scanned to the internal surface of the panel P. The panel P is thus exposed to the blue light. In this case, the light refraction and intensity of illumination are controlled while the light passes through the shutter 32, the compensating lens 33 and the filter 34. In the same manner as described for the above units 20 and 30, when the panel P is placed on the opening 40*a* of the red exposing unit 40, the light emitted from the light source 41 passes through the shutter 42, the compensating lens 43 and the filter 44 and in turn is scanned to the internal surface of the panel P. The panel P is thus exposed to the red light. In this case, the light refraction and intensity of illumination are controlled while the light passes through the shutter 42, the compensating lens 43 and the filter 44.

In the above exposing process, the internal surface of the panel P is exposed to the green light in the green exposing unit 20 and, thereafter, exposed to the blue light in the blue exposing unit 30. The panel P in turn is exposed to the red light in the red exposing unit 40. In the last exposing unit or the red exposing unit 40, a black matrix having the same pattern as the slots of the shadow mask M is formed on the panel's internal surface while the panel P is exposed to the red light.

In the above exposing process, the chucking units 60 move toward both sides of the panels P thereby causing the chucking members 63 of the units 60 to come into elastic contact with both sides of the panels P. The chucking units 60 in the above state move leftward in the drawings to move the panels P, placed on the waiting sections 50 and 51 and on the units 20, 30 and 40, by one pitch in the axial direction of the exposing device.

That is, the drive parts 61 of the chucking units 60 start to advance the actuating rods 61*a* toward both sides of the panels P, thereby making the shuttle frames 62 move toward both sides of the panels P. The chucking members 63, mounted to the inside surfaces of the shuttle frames 62, thus come into close contact with both sides of the panels P and thereby chuck the panels P. Thereafter, the actuating rods 64*a* of the panel feeding means 64 move leftward in the drawings thus moving both the driving parts 61 and the shuttle frames 62 leftward by one pitch. Therefore, the panels P chucked by the chucking members 63 move leftward by one pitch.

After the panels P move by one pitch on the waiting sections 50 and 51 and on the exposing units 20, 30 and 40 as described above, the actuating rods 61*a* of the driving parts 61 move backward to release the panels P from the chucking members 63. The panels P are thus seated on the waiting sections 50 and 51 and on the exposing units 20, 30 and 40. Thereafter, the actuating rods 64*a* of the feeding means 64 retract to make the shuttle frames 62 return to their original positions.

In the above panel feeding step, the panel P on the panel supplying conveyor unit 52 moves onto the initial waiting section 50. Meanwhile, the completely exposed panel P on the final waiting section 51 moves onto the panel distributing conveyor unit 53 so as to be fed to a following process.

As described above, the present invention provides an exposing device for CRTs which exposes a plurality of panels with shadow masks to R, G and B light while moving the panels by one pitch, thereby forming black matrixes on the internal surfaces of the panels. As the exposing device exposes the panels to the light while moving the panels by one pitch, the device remarkably saves processing time and reduces cost. In accordance with the above exposing device, the panels are exposed to the light under the same conditions. Therefore, the device uniforms the quality of black matrixes formed on the internal surfaces of the panels thereby uniforming the quality of the finished products.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. For example, the present invention may be adapted to an exposing process for fixing R, G and B fluorescent materials besides the above-described exposing process for forming the black matrixes of the panels.

What is claimed is:

1. An exposing device for fixing black matrixes of a given pattern on internal surfaces of panels, comprising:

green, blue and red light exposing units arranged in a casing one after another, each exposing unit having a light source, a shutter for partially intercepting the light emitted from said light source, a compensating lens for compensating for refraction of the light passing through the shutter, and a filter for controlling illumination intensity of the light;

means for selectively chucking a plurality of said panels seated on said exposing units; and means for moving said panels, chucked by said chucking means, by one pitch.

2. The exposing unit according to claim 1, further comprising initial and final waiting sections on which panels before exposing and after exposing stand by ready to be fed to said green light exposing unit and to be fed to a following process, respectively, said initial and final waiting sections being placed before said green light exposing unit and after said red light exposing unit, respectively.

3. The exposing device according to claim 1, wherein said chucking means is placed in each side of said exposing device and comprises:

a driving part having a rectilinearly movable actuating rod; and a longitudinal shuttle frame connected to said actuating rod and provided with a plurality of chucking members, said chucking members being selectively brought into close contact with sides of said panels in accordance with a rectilinear motion of said actuating rod.

* * * * *